US008828218B2

(12) United States Patent
Greeley et al.

(10) Patent No.: US 8,828,218 B2
(45) Date of Patent: Sep. 9, 2014

(54) PRETREATMENT OF FCC NAPHTHAS AND SELECTIVE HYDROTREATING

(71) Applicant: ExxonMobil Research and Engineering Company, Annandale, NJ (US)

(72) Inventors: John Peter Greeley, Gaithersburg, MD (US); Timothy Lee Hilbert, Fairfax, VA (US); William Joseph Novak, Bedminster, NJ (US); Rohit Garg, Easton, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 155 days.

(21) Appl. No.: 13/655,761

(22) Filed: Oct. 19, 2012

(65) Prior Publication Data

US 2013/0118952 A1 May 16, 2013

Related U.S. Application Data

(60) Provisional application No. 61/553,427, filed on Oct. 31, 2011.

(51) Int. Cl.

| | |
|---|---|
| ***C10G 59/02*** | (2006.01) |
| ***C10G 65/04*** | (2006.01) |
| ***C10G 69/04*** | (2006.01) |

(52) U.S. Cl.

CPC ..... *C10G 59/02* (2013.01); *C10G 2400/02* (2013.01); *C10G 65/04* (2013.01); *C10G 2300/207* (2013.01); *C10G 2400/28* (2013.01); *C10G 69/04* (2013.01); *C10G 2300/301* (2013.01); *C10G 2300/202* (2013.01); *C10G 2300/1044* (2013.01)

USPC ..... 208/57; 208/49; 208/142; 208/143; 208/144; 208/145; 208/208 R; 208/209; 208/210; 208/211

(58) Field of Classification Search

USPC ..... 208/49, 57, 142–145, 208 R, 209–211

See application file for complete search history.

(56) References Cited

U.S. PATENT DOCUMENTS

| | | | |
|---|---|---|---|
| 2,061,845 | A | 11/1936 | Morell |
| 2,707,700 | A | 5/1955 | Keith |

(Continued)

FOREIGN PATENT DOCUMENTS

| | | |
|---|---|---|
| CN | 1403539 A | 3/2003 |
| GB | 728505 | 4/1955 |
| GB | 823349 | 11/1959 |
| GB | 1016886 | 1/1966 |
| GB | 1155416 | 6/1969 |

OTHER PUBLICATIONS

De la Puente, G. et al. (2004) Energy & Fuels, 18, 460-464.*

(Continued)

*Primary Examiner* — Brian McCaig

(74) *Attorney, Agent, or Firm* — Bruce M. Bordelon; Chad A. Guice

(57) ABSTRACT

This invention provides methods for multi-stage hydroprocessing treatment of FCC naphthas for improving the overall production quantity of naphtha boiling-range materials during naphtha production for low sulfur gasolines. Of particular benefit of the present processes is the selective treating of cat naphthas to remove gums instead of undercutting the overall naphtha pool by lowering the end cutpoints of the cat naphtha fraction. This maximizes the amount of refinery cat naphtha that can be directed to the gasoline blending pool while eliminating existing processing problems in hydrodesulfurization units. The processes disclosed herein have the additional benefit of minimizing octane losses in the increased naphtha pool volume.

41 Claims, 4 Drawing Sheets

(56) References Cited

U.S. PATENT DOCUMENTS

| | | | | |
|---|---|---|---|---|
| 2,891,006 | A | 6/1959 | Chervenak et al. | |
| 3,239,453 | A | 3/1966 | Halik et al. | |
| 3,702,291 | A | 11/1972 | Jacquin et al. | |
| 3,764,521 | A | 10/1973 | Mathews et al. | |
| 3,969,222 | A * | 7/1976 | Hayes | 208/210 |
| 4,483,763 | A | 11/1984 | Kuk et al. | |
| 5,346,609 | A | 9/1994 | Fletcher et al. | |
| 6,107,533 | A | 8/2000 | Vebeliunas et al. | |
| 6,126,814 | A | 10/2000 | Lapinski et al. | |
| 6,773,579 | B2 | 8/2004 | Siskin et al. | |
| 6,858,766 | B2 | 2/2005 | Dai et al. | |
| 2006/0096893 | A1 * | 5/2006 | De Almeida et al. | 208/210 |
| 2007/0114156 | A1 | 5/2007 | Greeley et al. | |
| 2010/0288679 | A1 | 11/2010 | Himelfarb | |

OTHER PUBLICATIONS

Singh, J. et al. (1994). Fuel Science & Technology International, 12(6), 873-894.*

The International Search Report and Written Opinion of PCT/US2012/061406 dated Jul. 5, 2013.

Liao, K. et al., "Coking Diesel by FS Non-hydrotreating Process", Petroleum Science and Technology, 2009, vol. 27, issue 2, pp. 158-167.

Rahimi, P. et al., "Effect of Hydrotreating on the Stability of Synthetic Crude from Western Canada", Preprints of Symposia—American Chemical Society, Division of Fuel Chemistry, 1998, vol. 43, issue 1, pp. 13-17.

* cited by examiner

| Day # | | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|
| **Process Conditions** | | | | | | | | | | | | | | | | | |
| Temperature ($^{o}$F) | | 350 | 350 | 350 | 350 | 350 | 325 | 325 | 325 | 325 | 325 | 375 | 375 | 375 | 375 | 350 | 350 |
| Pressure (psig) | | 530 | 530 | 530 | 530 | 530 | 530 | 530 | 530 | 530 | 530 | 530 | 530 | 530 | 530 | 530 | 530 |
| Space Velocity ($hr^{-1}$) | | 4 | 4 | 4 | 4 | 4 | 4 | 4 | 4 | 4 | 4 | 4 | 4 | 4 | 4 | 2 | 2 |
| Treat Gas Reat (SCF/B) | | 600 | 600 | 600 | 600 | 600 | 600 | 600 | 600 | 600 | 600 | 600 | 600 | 600 | 600 | 600 | 600 |
| | | | | | | | | | | | | | | | | | |
| **Properties** | **Feed** | **Product** | | | | | | | | | | | | | | | |
| Gum Content (mg/100ml) | | | | | | | | | | | | | | | | | |
| - Washed Gum Content | 39.5 | | | | 1 | 2.5 | | | | 2.5 | | | | 0.5 | | | 1 |
| - Unwashed Gum Content | 43.5 | | | | 6 | 9 | | | | 9 | | | | 4 | | | 6 |
| Sulfur (wt%) | 0.566 | | | | 0.553 | 0.555 | | | | 0.564 | | | | 0.536 | | | |
| Bromine # | 11.53 | | | | 9.31 | | | | | 9.95 | | | | 8.25 | | | 8.5 |

Process Conditions and Product Results from Example

FIGURE 4

PRETREATMENT OF FCC NAPHTHAS AND SELECTIVE HYDROTREATING

CROSS-REFERENCE TO RELATED APPLICATIONS

This application claims priority to U.S. Provisional Ser. No. 61/553,427 filed Oct. 31, 2011, herein incorporated by reference in its entirety.

FIELD OF THE INVENTION

This invention provides methods for multi-stage hydroprocessing treatment of FCC (or "cat") naphthas for improving the overall production quantity of naphtha boiling-range materials during naphtha production for low sulfur gasolines.

BACKGROUND OF THE INVENTION

An important process to the overall gasoline production in the world is the refining Fluid Catalytic Cracking ("FCC") related processes. FCCs utilize very small particulate catalysts which are raised to very high temperatures and subsequently fluidized. These fluidized particles contact high molecular weight petroleum feeds and catalytically "crack" these larger hydrocarbon molecules to lower boiling products which are more valuable products. Most FCC processes contact heavy feed oils (such as vacuum gas oils, atmospheric gas oils, and often petroleum resids) with the fluidized catalysts typically with the goal to maximize naphtha production volumes.

In the FCC process these low-value, high boiling point hydrocarbon feedstocks are catalytically converted into more valuable products by contacting the feeds with fluidized catalyst particles in the process. In modern "short contact time" fluidized catalytic cracking (FCC) units, the hydrocarbon feedstocks are typically contacted with the fluidized catalyst particles in the riser section of the FCC reactor. The contacting between feed and catalyst is controlled according to the type of product desired. In catalytic cracking of the feed, reactor conditions such as temperature and contact time are controlled to maximize the products desired, such as naphthas, and minimize the formation of less desirable products such as light gases and coke.

The FCC naphthas derived from such processes are very valuable products as they are used as a component in final gasoline production. FCC naphthas can often account for about 50% or more of the overall "gasoline blending feedstock" in a refinery. Additionally FCC naphthas typically have a relatively high octane value as compared to "straight run" naphthas that are typically produced by a refinery's crude unit. This high octane value of the FCC naphthas is in large part due to the high olefin content of the FCC naphthas. As such, maximizing the total of production of FCC naphthas suitable for gasoline blending is of significant importance to any commercial refinery.

However, due to environmental regulations imposed within the last 10 to 15 years, most commercial gasolines have to meet a very low sulfur content specification of less than 30 ppmw sulfur. Most FCC naphthas cannot meet this low sulfur specification and must further undergo some type of hydrodesulfurization processing in order to meet these low sulfur specifications. An example of a preferred naphtha hydrodesulfurization processes is the SCANFINING® process which is licensed by the ExxonMobil Corporation. These processes utilize specialized catalysts and processes targeting desulfurization of naphthas to meet low sulfur gasoline specifications while retaining high octane values in the desulfurized naphtha products.

However, a problem exists in the art that problems can be experienced in many naphtha hydrodesulfurization processes due to equipment pluggage, catalyst bed pluggage and catalyst deactivation especially when treating cat naphthas. Typically, most cat naphthas are required to be sent for further catalytic hydrodesulfurization. This is due to their high sulfur content (usually well above 100 ppmw sulfur).

However, due to pluggage problems in the naphtha hydrodesulfurization ("HDS") reactors and associated equipment when operating with certain (not all) cat naphthas, a present practice is to make a lighter boiling point end cuts on the cat naphtha fraction. That is, instead of making a full cut cat naphtha (say to a full 450° F., end point distillation), the refiner may, for instance, make a boiling point cat naphtha fractionation end cut at 400° F. While this may help alleviate the problems in the naphtha HDS reactor units, this presents a significant cut in the refinery's overall FCC gasoline production. In this case, these "cut" gasoline fractions typically have to be sent to lower value kerosene or distillate fuel products. This action results in a significant negative economic impact to the refinery.

What is needed in the industry is a low cost, low capital process for pretreating and hydrodesulfurizing FCC "cat" naphthas in order to eliminate these plugging problems or the alternative disadvantaged process of downgrading portions of the cat naphtha pool to lower value products. What is needed is a process for solving these problems while still obtaining a high-volume, low-sulfur, and high-octane naphtha blendstock pool for gasoline production.

SUMMARY OF THE INVENTION

A first main embodiment of the invention relates to a process for selectively pretreating and desulfurizing a catalytically cracked naphtha feedstream, comprising:

- contacting, in a pretreater reactor, the naphtha feedstream and a first hydrogen-containing treat gas with a pretreater catalyst comprising an alumina-containing support and at least one Column 6 metal and at least one Column 8, 9 or 10 metal, wherein the gum content of the hydrocarbon stream is at least 5 mg/1000 ml, and the conditions within the pretreater reactor are about 100 to 1000 psig and about 300 to 400° F., and the first hydrogen-containing treat gas rate is about 300 to 1000 SCF/B;
- retrieving a pretreater product stream from the pretreater reactor wherein the pretreater product stream has a gum content of less than 20% of the gum content of the naphtha feedstream;
- heating the pretreater product stream;
- contacting, in a first naphtha hydrodesulfurization reactor, the pretreater product stream and a second hydrogen-containing treat gas with a first naphtha hydrodesulfurization catalyst comprising at least one Column 6 metal and at least one Column 8, 9 or 10 metal, wherein the conditions within the first naphtha hydrodesulfurization reactor are about 100 to 1000 psig and about 400 to 750° F., and the second hydrogen-containing treat gas rate is about 1000 to 4000 SCF/B; and
- retrieving a first naphtha hydrodesulfurization product stream from the first naphtha hydrodesulfurization reactor;

wherein the first naphtha hydrodesulfurization product stream has a lower sulfur content than the naphtha feedstream.

In another embodiment, the process described in the first main embodiment further comprises:

cooling the first naphtha hydrodesulfurization product stream;

sending the cooled first naphtha hydrodesulfurization product stream to a product separator and removing at least a portion of the hydrogen and $H_2S$ as a product separator overhead gas and removing a separator liquid product stream comprising hydrocarbon components boiling in the range of 80 to 450° F.;

heating the separator liquid product stream;

sending the heated separator liquid product stream to a product stripper wherein the heated separator liquid product stream contacts a series of internal fractionating devices selected from distillation trays, packing and grids;

removing a stripper overhead gas from the product stripper;

separating the stripper overhead gas into an overhead receiver offgas comprising $H_2S$ and ethane and an LPG liquid stream comprising $C_3$, $C_4$, and $C_5$ hydrocarbons;

removing a desulfurized naphtha product stream from the product stripper;

sending at least a portion of the desulfurized naphtha product stream to gasoline blending; and heating at least a portion of the desulfurized naphtha product stream and returning it to the product stripper.

In another embodiment, the process above further comprises:

cooling the second naphtha hydrodesulfurization product stream;

sending the cooled first naphtha hydrodesulfurization product stream to a product separator and removing at least a portion of the hydrogen and $H_2S$ as a product separator overhead gas and removing a separator liquid product stream comprising hydrocarbon components boiling in the range of 80 to 450° F.;

heating the separator liquid product stream;

sending the heated separator liquid product stream to a product stripper wherein the heated separator liquid product stream contacts a series of internal fractionating devices selected from distillation trays, packing and grids;

removing a stripper overhead gas from the product stripper;

separating the stripper overhead gas into an overhead receiver offgas comprising $H_2S$ and ethane and an LPG liquid stream comprising $C_3$, $C_4$, and $C_5$ hydrocarbons;

removing a desulfurized naphtha product stream from the product stripper;

sending at least a portion of the desulfurized naphtha product stream to gasoline blending; and heating at least a portion of the desulfurized naphtha product stream and returning it to the product stripper.

A second main embodiment of the invention relates to a process for selectively pretreating and desulfurizing a catalytically cracked naphtha feedstream, comprising:

contacting, in a pretreater reactor, the naphtha feedstream and a first hydrogen-containing treat gas with a pretreater catalyst comprising an alumina-containing support and at least one Column 6 metal and at least one Column 8, 9 or 10 metal, wherein the gum content of the hydrocarbon stream is at least 5 mg/100 ml, and the conditions within the pretreater reactor are about 100 to 1000 psig and about 300 to 400° F., and the first hydrogen-containing treat gas rate is about 300 to 1000 SCF/B;

retrieving a pretreater product stream from the pretreater reactor wherein the pretreater product stream has a gum content of less than 20% of the gum content of the naphtha feedstream;

heating the pretreater product stream;

contacting, in a first naphtha hydrodesulfurization reactor, the pretreater product stream and a second hydrogen-containing treat gas with a first naphtha hydrodesulfurization catalyst comprising at least one Column 6 metal and at least one Column 8, 9 or 10 metal, wherein the conditions within the first naphtha hydrodesulfurization reactor are about 100 to 1000 psig and about 400 to 750° F., and the second hydrogen-containing treat gas rate is about 1000 to 4000 SCF/B;

retrieving a first naphtha hydrodesulfurization product stream from the first naphtha hydrodesulfurization reactor wherein the first naphtha hydrodesulfurization product stream has a lower sulfur content than the naphtha feedstream;

removing at least a portion of the hydrogen and $H_2S$ from the first naphtha hydrodesulfurization product stream there by producing an interstage liquid stream;

contacting, in a naphtha conversion reactor, the interstage liquid stream and a third hydrogen-containing treat gas with a naphtha conversion catalyst comprising an alumina-containing support and an acidic zeolite with a pore size from about 5 to 7 Å, wherein the conditions within the naphtha conversion reactor are about 300 to 1500 psig and about 300 to 800° F., and the third hydrogen-containing treat gas rate is about 500 to 4000 SCF/B; and retrieving a naphtha conversion product stream from the naphtha conversion reactor;

wherein the naphtha conversion product stream has a higher olefin content than the first naphtha hydrodesulfurization product stream.

In more preferred embodiments of the processes above, the pretreater product stream has a gum content of less than 10% of the gum content of the naphtha feedstream. In other preferred embodiments, more than 70% of the olefins present in the naphtha feedstream are retained in the pretreater product stream.

In other preferred embodiments, the naphtha feedstream is a full-cut naphtha boiling substantially in the range of about 80 to 450° F. In other preferred embodiments, the naphtha feedstream is a heavy cat naphtha boiling substantially in the range of about 250 to 450° F. In yet other preferred embodiments, a light cat naphtha stream, boiling substantially in the range of about 80 to 250° F., is added to the pretreater product stream prior to entering the first naphtha hydrodesulfurization reactor.

BRIEF DESCRIPTION OF THE FIGURES

FIG. 4 is a table showing the process conditions and process results from the pilot plant testing performed in example herein.

DETAILED DESCRIPTION OF PREFERRED EMBODIMENTS

Figure 1:
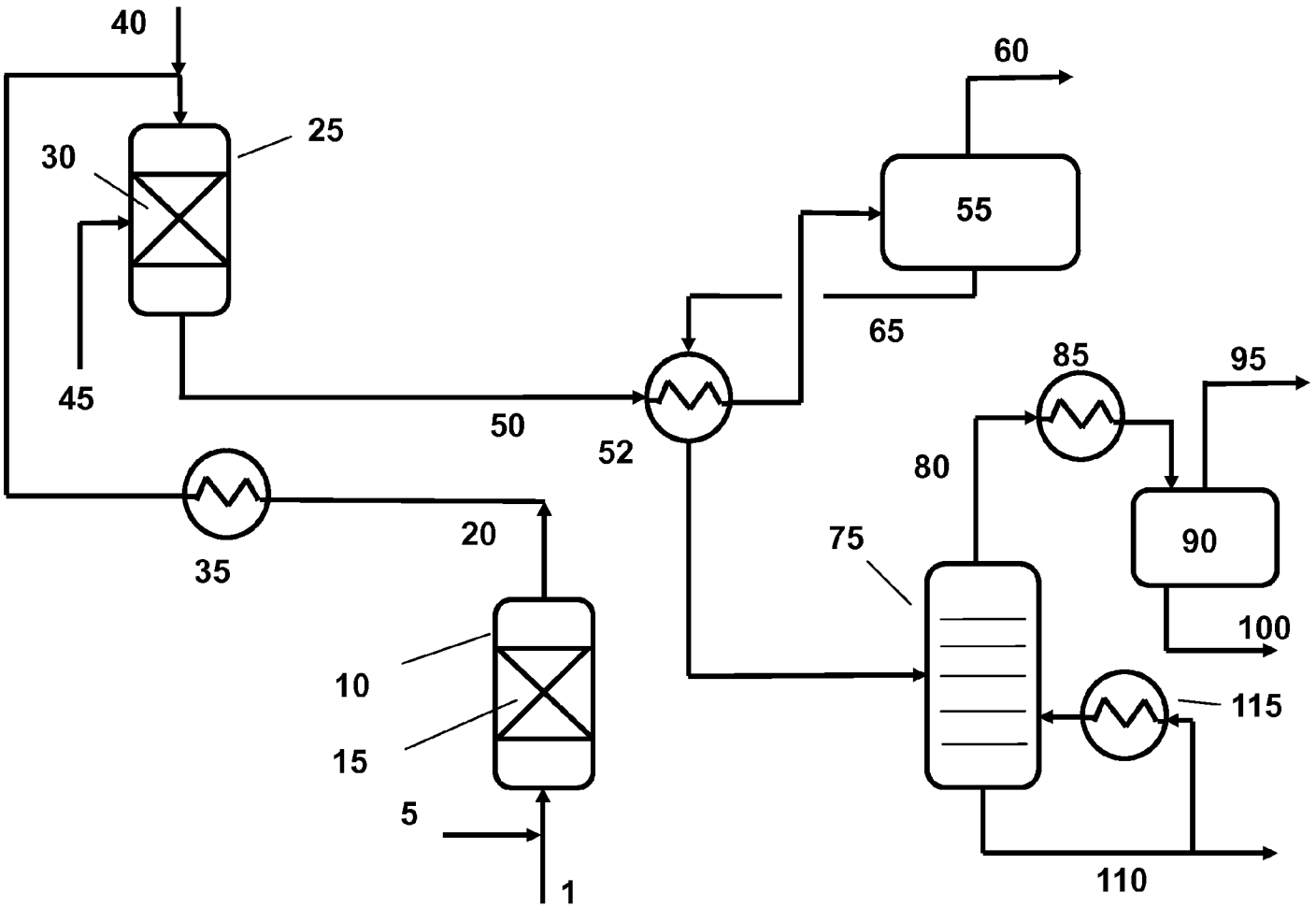
FIG. 1 is a simplified schematic of a first main preferred embodiment of the selective naphtha pretreatment and hydrodesulfurization process of the present invention which utilizes a selective naphtha pretreater and a selective naphtha hydrodesulfurization reactor.

As noted, due to strict environmental regulations imposed gasoline sulfur content to less than 30 ppmw sulfur, most FCC naphthas cannot meet this low sulfur specification and must further undergo some type of naphtha hydrodesulfurization processing in order to meet these low sulfur specifications. However, some naphtha hydrodesulfurization processes experience pluggage and catalyst deactivation problems when treating cat naphtha range materials, particularly when significant amounts of heavy cat naphthas ("HCNs") are included in the feed composition. Typically, cart naphthas are required to be sent for further catalytic hydrodesulfurization. This is due to their high sulfur content (usually above about 100 ppmw sulfur). A cat naphtha (or "full cut" cat naphtha) stream boils substantially in the range of about 80 to 450° F. Sometimes the cap naphtha can be further separated into a heavy cat naphtha ("HCN") and a light cat naphtha ("LCN"). HCNs typically boil substantially in the range of about 200 to 450° F., while LCNs typically boil substantially in the range of about 80 to 250° F. Similar to heavy cat naphthas, light cat naphtha fractions can also be sent for further hydrodesulfurization processes depending upon the sulfur content of the LCN stream.

However, due to pluggage problems in the naphtha hydrodesulfirization ("HDS") reactors and associated equipment when operating with certain (not all) cat naphthas, the present practice is to make a lighter boiling point end cut on the cart naphtha. That is, instead of making a full cut cat naphtha (say to a full 450° F., end point distillation), the refiner may, for instance, make a boiling point cat naphtha fractionation end cut at 400° F. While this may help alleviate the problems in the naphtha HDS reactor units, this presents a significant cut in the overall FCC gasoline production. In this case, these "cut" gasoline fractions typically have to be sent to lower value kerosene or distillate fuel products. This has a significant negative economic impact to the refinery.

It has been discovered that many modern FCC naphtha streams have high amounts of gum and/or gum precursor contents. The gum content can be very high, often 25 or more milligrams (mg) of gum per 100 milliliters (ml) of naphtha, as measured by ASTM Standard D381-09. The gum content in the FCC naphthas may be becoming a greater factor as the raw crude feedstocks are becoming more challenged, i.e., higher asphalt contents, higher high molecular weight sulfur and nitrogen heteroatom contents, etc., as are being experienced in the more limited crude supplies from the Middle East, Africa and South America, as well as from more non-conventional crudes derived from shale and tar sands. These gum and/or gum precursor contents in the FCC naphthas are believed to be a root cause of the significant problems in the naphtha hydrodesulfurization units, causing reactor catalyst bed pluggage, pre-heat train exchanger pluggage, high reactor pressure drops, deactivation of catalysts, and unit shutdowns.

In the invention herein is provided a process for treating a cat naphtha to remove these fouling components and then treating the resulting naphtha in a hydrodesulfurization process to remove sulfur in an amount necessary to meet current low sulfur gasoline specifications while retaining a high olefin content (octane) in the final naphtha product. The present invention has many benefits as will be described in more detail below. The first being that the gum content of the cat naphtha is reduced significantly and the associated problems in the naphtha hydrodesulfurization stages (such as pluggage and catalyst deactivation) are eliminated or at least significantly minimized. This present invention has the additional benefit of being able to maintain essentially the entire "full-cut" FCC cat naphtha in the gasoline pool (i.e., not requiring the refiner to make unnecessary fractionation cuts on the FCC naphtha) which has very significant positive ramifications on the refinery economics. Additionally, as will be shown, the invention of the present process solves these problems and provides these economic benefits with minimal loss of octane in the FCC naphtha.

A schematic of a first main preferred embodiment of the present invention is shown in FIG. 1. Here, naphtha feed 1 is combined with a hydrogen-containing treat gas 5, and sent to a pretreater reactor 10. The naphtha feed can be a full range naphtha feed (substantially boiling in the range of 80 to 450° F.). However, in an alternate embodiment, a light cat naphtha fraction (substantially boiling in the range of 80 to 250° F.) is separated from a heavy cat naphtha fraction (substantially boiling in the range of 200 to 450° F.) and only the heavy cat naphtha is sent to pretreater reactor 10 and at least a portion of the light cat naphtha is added to the pretreater product stream 20 for further processing according to the embodiments of the present invention.

In the pretreating reactor, the naphtha feed and hydrogen are contacted with a pretreater catalyst bed 15 under conditions sufficient to convert at least a portion of the of the naphtha feed into a pretreater product stream 20. Preferably, the conditions within the pretreater reactor are about 100 to 1000 psig and about 300 to 400° F., and more preferably about 450 to 650 psig and about 300 to 400° F. Even more preferably, the conditions within the pretreater reactor are about 500 to 600 psig and about 325 to 375° F. In preferred embodiments, the liquid hourly space velocity is about 2 to 8 $hr^{-1}$, and even more preferably about 4 to 6 $hr^{-1}$. In other preferred embodiments, the hydrogen-containing treat gas rate is about 300 to 1000 standard cubic feet/barrel of naphtha feed (SCF/B), and even more preferably about 450 to 800 SCF/B.

The pretreater catalyst 15 is preferably a supported catalyst comprising at least one Column 6 metal (under the current IUPAC notation of the Periodic Table of Elements wherein the columns are denoted 1 through 18) and at least one Column 8, 9 or 10 metal (under the current IUPAC notation). The catalyst preferably contains an alumina support, while the support may alternatively be an alumina-silica support. More preferably, the support contains at least 85 wt % alumina based on the weight of the support. In preferred embodiments of the pretreater catalyst, the Column 6 metal is selected from Mo and W, and the Group Column 8, 9 or 10 metal is selected from Co and Ni. Most preferably, the pretreater catalyst is comprised of Mo and Ni. In an alternative embodiment, the pretreater catalyst is comprised of active impregnated metals consisting essentially of Mo and Ni. Most preferably, the pretreater catalyst is in the sulfided condition.

The processes described herein are particularly beneficial when utilized with cat naphthas that have high gum contents as measured by ASTM Standard D381-09. It should be noted that "gum contents" as used herein mean the "washed gum content" per ASTM Standard D381-09 unless otherwise explicitly noted. Preferably, the gum content of the naphtha feed is at least 5 milligrams (mg) of gum per 100 milliliters (ml) of naphtha. Even more preferably, the processes herein are especially effective when the gum content of the naphtha feed is at least 25 milligrams (mg) of gum per 100 milliliters (ml) of naphtha; and even more preferably when the gum content of the naphtha feed is at least 35 milligrams (mg) of gum per 100 milliliters (ml) of naphtha.

The processes herein are also particularly beneficial when the sulfur content of the cat naphtha to the pretreater reactor is at least 100 ppmw sulfur, more preferably at least 500 ppmw sulfur; even more preferably at least 1000 ppmw sulfur and even more preferably at least 3000 ppmw sulfur based on the weight of the cat naphtha feed to the pretreater reactor.

Returning to the embodiment in FIG. 1, in the pretreater reactor 10 the naphtha feed 1 and hydrogen-containing treat gas 5 are contacted with the pretreater catalyst 15 at conditions as described above and resulting in a pretreater product stream 20. Here, as will be described more fully in the Examples herein, the resulting pretreater product stream 20 has a considerably lower gum content than the naphtha feed 1. Preferably, the pretreater product stream 20 has a gum content of less than 20%, more preferably less than 10% and even more preferably less than 5%, of the gum content of the naphtha feed 1. In the most preferred embodiments, the gum content of the pretreater product stream 20 is less than 10 milligrams (mg) of gum per 100 milliliters (ml) of naphtha, more preferably less than 5 milligrams (mg) of gum per 100 milliliters (nil) of naphtha less than 2.5 milligrams (mg) of gum per 100 milliliters (ml) of naphtha.

It is important to note that the process conditions and catalysts within the pretreater reactor 10 are designed herein such that significant desulfurization of the naphtha feed does not occur in the pretreater reactor 10. As noted prior, preferably, the pressure within the pretreater reactor is only about 450 to 650 psig and only about 300 to 400° F. In preferable embodiments, hydrogen treat gas purity is at least 85 mol % and the hydrogen partial pressure is from about 350 to 500 psia. Under the combination of reactor parameters specified herein, the sulfur removal from the naphtha feed 1 is kept very low and the naphtha material loss in the pretreater reactor is very low. This is very important as the present process can effectively convert a high gum content cat naphtha feed into a pretreated feed for further naphtha desulfurization at almost no naphtha volume loss. In preferred embodiments of the processes herein, the pretreater product stream 20 retains at least 95 wt %, more preferably at least 100 wt % of the amount of naphtha weight boiling point materials (hydrocarbons boiling in the range of 80 to 450° F.) in the naphtha feed 1. Additionally, in preferred embodiments herein, the sulfur content, by wt %, of the naphtha weight boiling point materials material (hydrocarbons boiling in the range of 80 to 450° F.) in the pretreater product stream 20 (i.e., those naphtha materials that are not converted to lighter products, such as $H_2S$, or heavier products) is at least 80%, more preferably, at least 90% of the sulfur content, by wt %, of the naphtha weight boiling point materials material (hydrocarbons boiling in the range of 80 to 450° F.) in the naphtha feed 1.

As noted prior, it is of significant importance that the processes for naphtha desulfurization keep the amount of olefin saturation as low as possible. As will be noted in the data in the Examples, the processes of the present invention exhibit unexpectedly low olefin saturation, as measured by the Bromine # of the sample per ASTM Standard D1159-07. The processes of the present invention result in a pretreater product stream 20 wherein more than 70%, even more preferably more than 80%, and most preferably more than 85% of the olefins that were present in the naphtha feed 1 are retained in the pretreater product stream 20 (i.e., not converted to other species).

Continuing with FIG. 1, in the present invention the pretreater product stream 20 which is now compatible with further naphtha desulfurization processes is sent to a naphtha hydrodesulfurization reactor 25 which contains a naphtha hydrodesulfurization catalyst 30. Herein, when there are more than one naphtha hydrodesulfurization reactors, this reactor may be alternatively be designated as the first (or first stage) naphtha hydrodesulfurization reactor. As noted prior, one benefit of the specific pretreater reactor 10 conditions and catalysts, the pretreater reactor can be run under very low temperature conditions. Not only is this favorable to the kinetics of the present invention, but also saves energy. As such, a heat exchanger 35 (or more suitably a series of heat exchangers) is utilized to raise the temperature of the pretreater product stream 20 before it enters the naphtha hydrodesulfurization reactor 25. This heat exchanger can be of any conventional means for heating a fluid, including, but not limited to fired heaters, fluid heat transfer exchangers, or combinations thereof.

Although not shown in FIG. 1, a separator vessel may be placed in the circuit between the pretreater reactor 10 and the naphtha hydrodesulfurization reactor 25 to remove light gases from the pretreater product stream 20; however, this is generally not required due to the very low (substantially non-existent) losses in the naphtha boiling range materials, as noted prior, experienced in the pretreater reaction processes herein.

In a first preferred embodiment, the reaction conditions in the naphtha hydrodesulfurization reactor 25 are such that the pretreater product stream 20 is substantially in the vapor phase either prior to contacting the naphtha hydrodesulfurization catalyst 30 or after contacting the naphtha hydrodesulfurization catalyst. The reaction conditions in the naphtha hydrodesulfurization reactor 25 include 100 to 1000 psig and 400 to 750° F., more preferably 300 to 600 psig and 400 to 750° F., with a first naphtha HDS reactor treat gas 40 rate of about 1000 to 4000 SCF/B. In preferred embodiments, a first naphtha HDS reactor interbed quench 45 is utilized. Preferably, the first naphtha HDS reactor treat gas 40 and the first naphtha HDS reactor interbed quench 45 contain at least 75 mol %, more preferably at least 85 mol % hydrogen.

Preferably, the naphtha hydrodesulfurization catalyst 30 is a catalyst selective for removing sulfur while minimizing olefin saturation (i.e., olefin losses). In a preferred embodiment, the naphtha hydrodesulfurization catalyst 30 is comprised of at least one Column 6 metal and at least one Column 8, 9 or 10 metal (under the current IUPAC designation of the Periodic Table of Elements). Most preferably, the naphtha hydrodesulfurization catalyst 30 is comprised of Mo and Co. Preferably, these active metals are incorporated on a support which is comprised of alumina. Preferably, the support material is at least 85 wt % alumina, more preferably at least 95 wt % alumina based on the total weight of the support material. In another preferred embodiment, the support is comprised of silica.

Returning to FIG. 1, a first naphtha hydrodesulfirization product stream 50 is recovered from the naphtha hydrodesulfurization reactor 25. Here, the naphtha weight boiling point materials material (hydrocarbons boiling in the range of 80 to 450° F.) in the first naphtha hydrodesulfurization product stream 45 are substantially lower in sulfur content than the pretreater product stream 20 to the naphtha hydrodesulfurization reactor 25. In preferred embodiments the sulfur content, by weight % of naphtha, in the first naphtha hydrodesulfurization product stream 50 is less than 20%, more preferably less than 10% and even more preferably less than 5% of the sulfur content in the pretreater product stream 20. Preferably, the sulfur content in the first naphtha hydrodesulfurization product stream 50 is less than 100 ppmw sulfur, more preferably less than 50 ppmw sulfur, and most preferably less than 30 ppmw sulfur.

In the current embodiment illustrated in FIG. 1, the first naphtha hydrodesulfurization product stream 50 is cooled in heat exchanger 52 (or more preferably a series of heat exchangers denoted by element 52) and sent to a product separator 55. Here, the product separator 55 is maintained at a high pressure, preferably at least 75%, more preferably at least 85% of the absolute pressure from the outlet of the naphtha hydrodesulfurization reactor 25. The temperature of the product separator 55 is preferably lowered to less than about 300° F., more preferably less than about 250° F. Here, a separator vapor product stream 60 is removed which contains most of the $H_2S$ product present in the first naphtha hydrodesulfurization product stream 50. While the separator vapor product stream 60 may contain some light hydrocarbons (typically some methane and/or ethane), most of the hydrocarbons are removed from the product separator 55 via a separator liquid product stream 65.

The separator liquid product stream 65 is then sent to a product stripper 75. In the embodiment shown in FIG. 1, although not required, in this configuration the separator liquid product stream 65 is utilized to heat at least a portion of the first naphtha hydrodesulfurization product stream 50 in heat exchanger 52.

In the product stripper 75, the lighter hydrocarbon components are separated from the naphtha product components of the separator liquid product stream 65. In the product stripper 75, a stripper overhead gas 80 is removed and passed through heat exchanger(s) 85 which cool the stripper overhead gas 80 to the stripper overhead receiver 90. In the stripper overhead receiver 90 an overhead receiver offgas 95 is removed which contains mostly $H_2S$ and light hydrocarbons such as methane and ethane. Most of the $C_3$, $C_4$, and $C_5$ light plant gas (LPG) products are removed via the LPG liquid stream 100.

The product stripper 75 preferably contains internal distillation trays, packing, and/or grids to assist in separating the stripper overhead gas 80 from the desulfurized naphtha product stream 110. In preferred embodiments, the desulfurized naphtha product stream 110 contains most, if not substantially all, of the naphtha boiling point range material (boiling from 80 to 450° F.). The desulfurized naphtha product stream 110 can be sent for gasoline blending, and is an especially useful component in high octane, ultra-low sulfur specification gasolines. In a preferred embodiment, at least a portion of the desulfurized naphtha product stream 110 is heat via heat exchanger(s) 115 and recycled back to the product stripper 75.

The process results in a treated naphtha product meeting ultra-low sulfur specification while retaining a very high amount of the olefin content of the naphtha feed to the process. The processes herein also result in a very high retention of overall naphtha volume (i.e., very low conversion of naphtha feed to non-naphtha products). Preferably the desulfurized naphtha product stream 110 contains at least 90 wt %, more preferably at least 95 wt % of the amount of naphtha weight boiling point materials (hydrocarbons boiling in the range of 80 to 450° F.) that were present in the original naphtha feed 1.

Additionally, in the preferred embodiments herein, the desulfurized naphtha product stream 110 contains less than 100 ppmw sulfur, more preferably less than 50 ppmw sulfur, and most preferably less than 30 ppmw sulfur. In the preferred embodiments, the desulfurized naphtha product stream 110 contains more than 70%, even more preferably more than 80%, and most preferably more than 85% of the olefins that were present in the original naphtha feed 1 while maintaining the ultra-low sulfur levels described herein.

Figure 2:
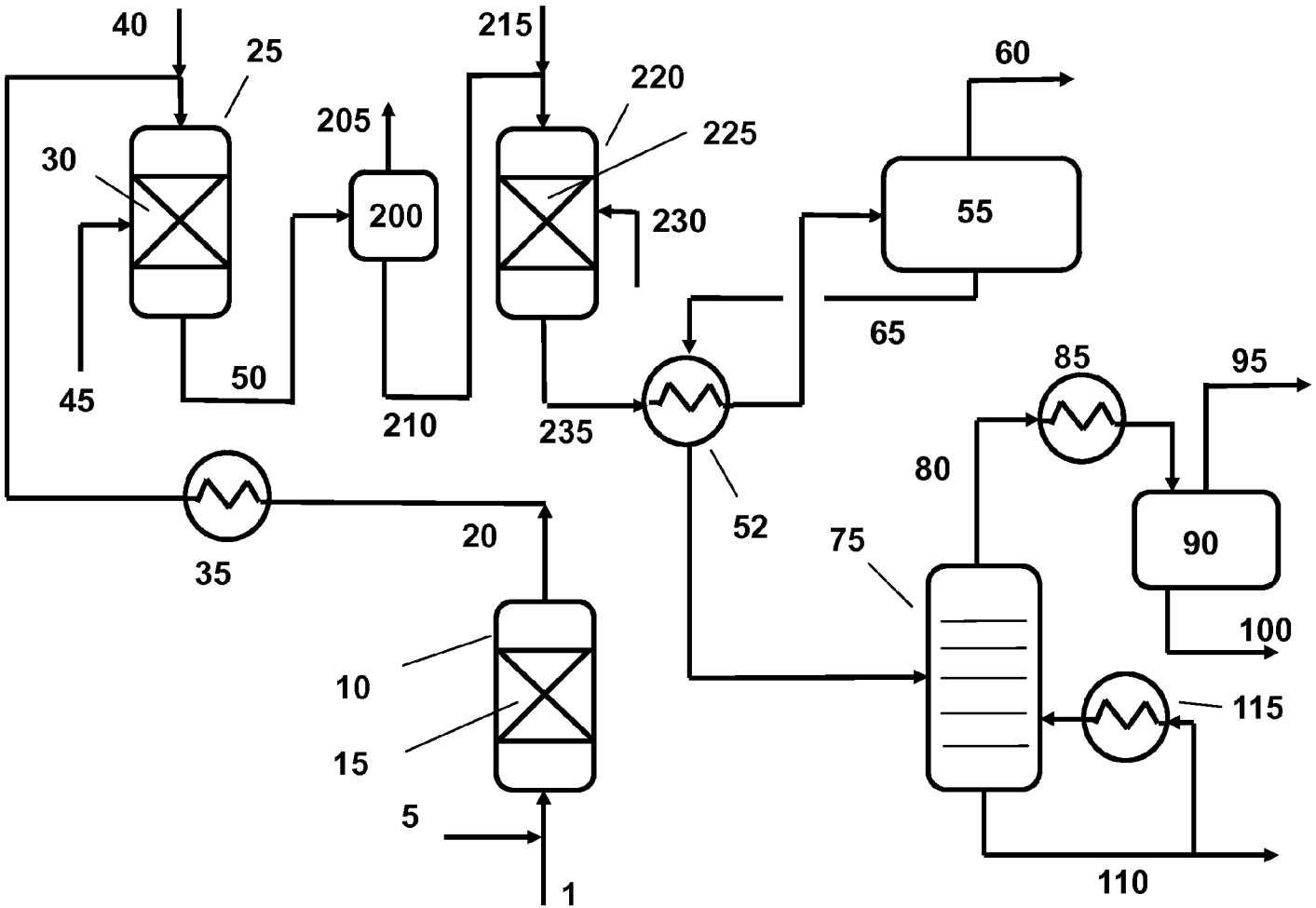
FIG. 2 is a simplified schematic of a second main preferred embodiment of the selective naphtha pretreatment and hydrodesulfurization process of the present invention which utilizes a selective naphtha pretreater and two selective naphtha hydrodesulfurization reactors.

FIG. 2 illustrates a simplified second main preferred embodiment of the present invention. Here, elements 1 through 50 and 52 through 115 are essentially the same as described in the first preferred embodiment described in the context of FIG. 1. However, here in FIG. 2, the first naphtha hydrodesulfurization product stream 50 is sent to an interstage high pressure separator 200. Here, an interstage offgas 205 containing a portion of the hydrogen and $H_2S$ present in the first naphtha hydrodesulfurization product stream 50 is removed from the process and an interstage liquid stream 210 is contacted with a second naphtha HDS reactor treat gas 215 which is sent to a second naphtha hydrodesulfurization reactor 220. Here, the stream is contacted with a second naphtha hydrodesulfurization catalyst 255 and a second naphtha hydrodesulfurization product stream 235 is removed from second naphtha hydrodesulfurization reactor. In this embodiment, the catalyst composition and conditions in the second naphtha hydrodesulfurization reactor 220 are similar to as described above for the first naphtha hydrodesulfurization reactor 25. Here, an optional second naphtha HDS reactor interbed quench 230 may also be utilized.

This second preferred embodiment of FIG. 2 is particularly desired in lieu of the first preferred embodiment of FIG. 1 particularly when very low sulfur specifications on the final naphtha desulfurized naphtha product stream 110 need to be met; particularly when the required sulfur content of the naphtha desulfurized naphtha product stream 110 is below 50 ppmw sulfur or more preferably below 30 ppmw sulfur. In this second preferred embodiment, it is preferred that the first naphtha hydrodesulfurization reactor 25 be run at less severe conditions than in the single reactor embodiment of FIG. 1 and that the sulfur content of the first naphtha hydrodesulfurization product stream 50 at least 100 ppmw sulfur, more preferably at least 500 ppmw sulfur.

Figure 3:
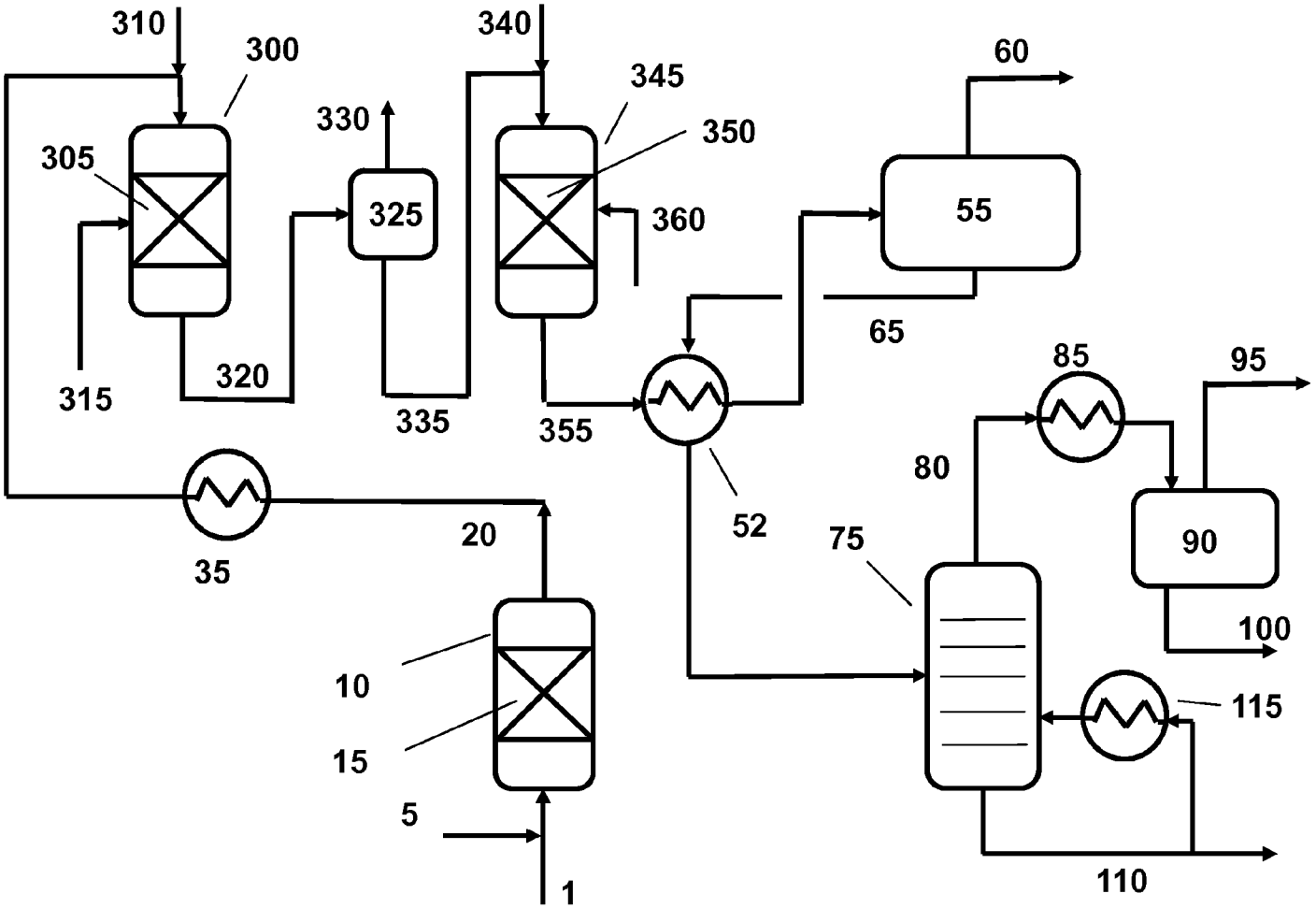
FIG. 3 is a simplified schematic of a third main preferred embodiment of the selective naphtha pretreatment and hydrodesulfurization process of the present invention which utilizes a selective naphtha pretreater, a naphtha hydrodesulfurization reactor and a naphtha conversion reactor.

FIG. 3 illustrates a simplified third main preferred embodiment of the present invention. In this embodiment of FIG. 3, elements 1 through 20, 35, and 52 through 115 are essentially the same as described in the first preferred embodiment described in the context of FIG. 1 and second preferred embodiment described in the context of FIG. 2 and will not be repeated here for the sake of brevity. In this third preferred embodiment as illustrated in FIG. 3, the pretreater product stream 20 which, which properties have been described in preferred embodiments 1 and 2 above is now compatible with further naphtha desulfurization processes is sent to a first naphtha hydrodesulfurization reactor 300 which contains a first naphtha hydrodesulfurization catalyst 305.

In this third main preferred embodiment, the reaction conditions in the first naphtha hydrodesulfurization reactor 300 are such that the pretreater product stream 20 is substantially two-phase (vapor and liquid) either prior to contacting the first naphtha hydrodesulfurization catalyst 305 or after contacting the first naphtha hydrodesulfurization catalyst. The reaction conditions in the first naphtha hydrodesulfurization reactor 300 include 300 to 1500 psig and 400 to 750° F. with a first naphtha HDS reactor treat gas 310 rate of about 1000 to 4000 SCF/B. In preferred embodiments, a first naphtha HDS reactor interbed quench 315 is utilized. Preferably, the first naphtha HDS reactor treat gas 310 and the first naphtha HDS reactor interbed quench 315 contain at least 75 mol %, more preferably at least 85 mol % hydrogen.

The first naphtha hydrodesulfurization catalyst 305 may be a conventional hydrotreating (desulfurization) catalyst. In a preferred embodiment, the first naphtha hydrodesulfurization catalyst 305 is comprised of at least one Column 6 metal and at least one Column 8, 9 or 10 metal (under the current IUPAC designation of the Periodic Table of Elements). More preferably, the first naphtha hydrodesulfurization catalyst 305 is comprised of at least one Column 6 metal selected from Mo and W and at least one Column 8, 9 or 10 metal selected from Co and Ni. Preferably, these active metals are incorporated on a support which is comprised of alumina. Preferably, the support material is at least 85 wt % alumina, more preferably at least 95 wt % alumina based on the total weight of the support material. In another preferred embodiment, the support is comprised of silica.

Returning to FIG. 3, a first naphtha hydrodesulfurization product stream 320 is recovered from the first naphtha hydrodesulfurization reactor 300. Here, the naphtha weight boiling point materials material (hydrocarbons boiling in the range of 80 to 450° F.) in the first naphtha hydrodesulfurization product stream 320 are substantially lower in sulfur content than the pretreater product stream 20 to the naphtha hydrodesulfurization reactor 300. In preferred embodiments the sulfur content, by weight % of naphtha, in the first naphtha hydrodesulfurization product stream 320 is less than 20%, more preferably less than 10% and even more preferably less than 5% of the sulfur content in the pretreater product stream 20. Preferably, the sulfur content in the first naphtha hydrodesulfurization product stream 320 is less than 100 ppmw sulfur, more preferably less than 50 ppmw sulfur, and most preferably less than 30 ppmw sulfur.

In the current preferred embodiment illustrated in FIG. 3, the first naphtha hydrodesulfurization product stream 320 is sent to an interstage high pressure separator 325. Here, an interstage offgas 330 containing a portion of the hydrogen and $H_2S$ present in the first naphtha hydrodesulfurization product stream 320 is removed from the process and an interstage liquid stream 335 is contacted with a first naphtha conversion reactor treat gas 340 which is sent to a first naphtha conversion reactor 345 where the stream is contacted with a first naphtha conversion catalyst 350 and a first naphtha conversion product stream 355 is removed from first naphtha conversion reactor. Herein, when there is only one naphtha conversion reactor, this reactor first naphtha conversion reactor 345 may be alternatively be referred to as simply "the naphtha conversion reactor".

In this third preferred embodiment illustrated in FIG. 3, the first naphtha conversion reactor 345 conditions include 300 to 1500 psig and 300 to 800° F. with a first naphtha conversion reactor treat gas 340 rate of about 500 to 4000 SCF/B. In preferred embodiments, a first naphtha conversion reactor interbed quench 360 is utilized. Preferably, the first naphtha conversion reactor treat gas 340 and the first naphtha conversion reactor interbed quench 360 contain at least 75 mol %, more preferably at least 85 mol % hydrogen.

In this embodiment of FIG. 3, the first naphtha conversion catalyst 350 is comprised of a support containing alumina. Alumina and alumina-silica supports are preferred. Preferably, the support contains at least 85 wt % alumina based on the weight of the support. Here, the first naphtha conversion catalyst 350 is further comprised of acidic zeolite with a pore size from about 5 to 7 Å. The zeolite is preferably ZSM-5. The first naphtha conversion catalyst 350 preferably has a surface area of at least 50 $m^2/g$, more preferably at least 100 $m^2/g$, and most preferably at least 120 $m^2/g$. Optionally, the first naphtha conversion catalyst 350 may be further comprised of at least one Column 6 metal and at least one Column 8, 9 or 10 metal (under the current IUPAC designation of the Periodic Table of Elements). More preferably, the first naphtha conversion catalyst 350 is comprised of at least one Column 6 metal selected from Mo and W and the at least one Column 8, 9 or 10 metal selected from Co, Ni, Pt and Pd. In a preferred embodiment, the at least one Column 6 metal is selected from Mo and W and the at least one Column 8, 9 or 10 metal is selected from Ni. In another preferred embodiment, the at least one Column 6 metal selected from W and at least one Column 8, 9 or 10 metal selected from Ni. In another preferred embodiment, the first naphtha conversion catalyst 350 may be comprised of at least one Column 10 metal selected from Pt and Pd.

In this third preferred embodiment, the olefin content of the treated naphtha material in the first naphtha conversion reactor 345 is significantly increased. In a preferred embodiment, the olefins content of the first naphtha conversion product stream 355 is at least 105%, and more preferably at least 110% of the olefin content of the first naphtha hydrodesulfurization product stream 320.

Additionally or alternatively, the present invention can be described according to one or more of the following embodiments.

Embodiment 1

A process for selectively pretreating and desulfurizing a catalytically cracked naphtha feedstream, comprising: contacting, in a pretreater reactor, the naphtha feedstream and a first hydrogen-containing treat gas with a pretreater catalyst comprising an alumina-containing support and at least one Column 6 metal and at least one Column 8, 9 or 10 metal, wherein the gum content of the hydrocarbon stream is at least 5 mg/10 ml, and the conditions within the pretreater reactor are about 100 to 1000 psig and about 300 to 400° F., and the first hydrogen-containing treat gas rate is about 300 to 1000 SCF/B; retrieving a pretreater product stream from the pretreater reactor wherein the pretreater product stream has a gum content of less than 20% of the gum content of the naphtha feedstream; heating the pretreater product stream; contacting, in a first naphtha hydrodesulfurization reactor, the pretreater product stream and a second hydrogen-containing treat gas with a first naphtha hydrodesulfurization catalyst comprising at least one Column 6 metal and at least one Column 8, 9 or metal, wherein the conditions within the first naphtha hydrodesulfurization reactor are about 100 to 1000 psig and about 400 to 750° F., and the second hydrogen-containing treat gas rate is about 1000 to 4000 SCF/B; and retrieving a first naphtha hydrodesulfurization product stream from the first naphtha hydrodesulfurization reactor; wherein the first naphtha hydrodesulfurization product stream has a lower sulfur content than the naphtha feedstream.

Embodiment 2

The process of embodiment 1, further comprising: cooling the first naphtha hydrodesulfurization product stream; sending the cooled first naphtha hydrodesulfurization product stream to a product separator and removing at least a portion of the hydrogen and $H_2S$ as a product separator overhead gas and removing a separator liquid product stream comprising hydrocarbon components boiling in the range of 80 to 450° F.; heating the separator liquid product stream; sending the heated separator liquid product stream to a product stripper wherein the heated separator liquid product stream contacts a series of internal fractionating devices selected from distillation trays, packing and grids; removing a stripper overhead gas from the product stripper; separating the stripper overhead gas into an overhead receiver offgas comprising $H_2S$ and ethane and an LPG liquid stream comprising $C_3$, $C_1$, and $C_5$ hydrocarbons; removing a desulfurized naphtha product stream from the product stripper; sending at least a portion of the desulfurized naphtha product stream to gasoline blending; and heating at least a portion of the desulfurized naphtha product stream and returning it to the product stripper.

Embodiment 3

The process of embodiment 1, further comprising: removing at least a portion of the hydrogen and $H_2S$ from the first naphtha hydrodesulfurization product stream there by producing an interstage liquid stream; contacting, in a second naphtha hydrodesulfurization reactor, the interstage liquid stream and a third hydrogen-containing treat gas with a second naphtha hydrodesulfurization catalyst comprising at least one Column 6 metal and at least one Column 8, 9 or 10 metal, wherein the conditions within the second naphtha hydrodesulfurization reactor are about 100 to 1000 psig and about 400 to 750° F., and the second hydrogen-containing treat gas rate is about 1000 to 4000 SCF/B; and retrieving a second naphtha hydrodesulfurization product stream from the second naphtha hydrodesulfurization reactor; wherein the second naphtha hydrodesulfurization product stream has a lower sulfur content than the first naphtha hydrodesulfurization product stream.

Embodiment 4

The process of embodiment 3, further comprising: cooling the second naphtha hydrodesulfurization product stream; sending the cooled first naphtha hydrodesulfurization product stream to a product separator and removing at least a portion of the hydrogen and $H_2S$ as a product separator overhead gas and removing a separator liquid product stream comprising hydrocarbon components boiling in the range of 80 to 450° F.; heating the separator liquid product stream; sending the heated separator liquid product stream to a product stripper wherein the heated separator liquid product stream contacts a series of internal fractionating devices selected from distillation trays, packing and grids; removing a stripper overhead gas from the product stripper; separating the stripper overhead gas into an overhead receiver offgas comprising $H_2S$ and ethane and an LPG liquid stream comprising $C_3$, $C_4$, and $C_5$ hydrocarbons; removing a desulfurized naphtha product stream from the product stripper; sending at least a portion of the desulfurized naphtha product stream to gasoline blending; and heating at least a portion of the desulfurized naphtha product stream and returning it to the product stripper.

Embodiment 5

The process of embodiment 1, further comprising: removing at least a portion of the hydrogen and $H_2S$ from the first naphtha hydrodesulfurization product stream there by producing an interstage liquid stream; contacting, in a naphtha conversion reactor, the interstage liquid stream and a third hydrogen-containing treat gas with a naphtha conversion catalyst comprising an alumina-containing support and an acidic zeolite with a pore size from about 5 to 7 Å, wherein the conditions within the naphtha conversion reactor are about 300 to 1500 psig and 300 to 800° F., and the third hydrogen-containing treat gas rate is about 500 to 4000 SCF/B; and retrieving a naphtha conversion product stream from the naphtha conversion reactor; wherein the naphtha conversion product stream has a higher olefin content than the first naphtha hydrodesulfurization product stream.

Embodiment 6

The process of embodiment 5, further comprising: cooling the naphtha conversion product stream; sending the cooled naphtha conversion product stream to a product separator and removing at least a portion of the hydrogen and $H_2S$ as a product separator overhead gas and removing a separator liquid product stream comprising hydrocarbon components boiling in the range of 80 to 450° F.; heating the separator liquid product stream; sending the heated separator liquid product stream to a product stripper wherein the heated separator liquid product stream contacts a series of internal fractionating devices selected from distillation trays, packing and grids; removing a stripper overhead gas from the product stripper; separating the stripper overhead gas into an overhead receiver offgas comprising $H_2S$ and ethane and an LPG liquid stream comprising $C_3$, $C_4$, and $C_5$ hydrocarbons; removing a desulfurized naphtha product stream from the product stripper; sending at least a portion of the desulfurized naphtha product stream to gasoline blending; and heating at least a portion of the desulfurized naphtha product stream and returning it to the product stripper.

Embodiment 7

The process of any of embodiments 3-4, wherein the sulfur content of the naphtha feedstream is at least 500 ppmw, the sulfur content of the first naphtha hydrodesulfurization product stream is at least 100 ppmw, and the sulfur content of the second naphtha hydrodesulfurization product stream is less than 30 ppmw.

Embodiment 8

The process of any of embodiments 5-6, wherein the olefin content of the naphtha conversion product stream is at least 5% greater than the olefin content of the first naphtha hydrodesulfurization product stream.

Embodiment 9

The process of any of embodiments 5-6 and 8, wherein the naphtha conversion catalyst is comprised of at least one Column 6 metal selected from Mo and W and at least one Column 8, 9 or 10 metal selected from Co, Ni, Pt and Pd.

Embodiment 10

The process of any of embodiments 5-6 and 8, wherein the naphtha conversion catalyst is comprised of at least one Column 10 metal selected from Pt and Pd.

Embodiment 11

The process of any of embodiments 5-6 and 8-10, wherein the naphtha conversion catalyst has a surface area of at least 50 $m^2/g$ and comprises ZSM-5.

Embodiment 12

The process of any of embodiments 1-6 and 8-11, wherein the sulfur content of the naphtha feedstream is at least 500 ppmw, and the sulfur content of the first naphtha hydrodesulfurization product stream is less than 100 ppmw.

Embodiment 13

The process of any previous embodiment, wherein the pretreater product stream has a gum content of less than 10% of the gum content of the naphtha feedstream.

Embodiment 14

The process of any previous embodiment, wherein the naphtha feedstream is a full-cut naphtha boiling substantially in the range of about 80 to 450° F.

Embodiment 15

The process of any of embodiments 1-13, wherein the naphtha feedstream is a heavy cat naphtha boiling substantially in the range of about 250 to 450° F.

Embodiment 16

The process of any previous embodiment, wherein a light cat naphtha stream, boiling substantially in the range of about 80 to 250° F., is added to the pretreater product stream prior to entering the first naphtha hydrodesulfurization reactor.

Embodiment 17

The process of any previous embodiment, wherein more than 70% of the olefins present in the naphtha feedstream are retained in the pretreater product stream.

Embodiment 18

The process of any previous embodiment, wherein the at least one Column 6 metal of the pretreater catalyst is W and the at least one Column 8, 9 or 10 metal of the pretreater catalyst is Ni.

Embodiment 19

The process of any previous embodiment, wherein the sulfur content, by wt %, of the naphtha-weight boiling point components (hydrocarbons boiling in the range of 80 to 450° F.) of the pretreater product stream is at least 80% of the sulfur content, by wt %, of the naphtha-weight boiling point components (hydrocarbons boiling in the range of 80 to 450° F.) of the naphtha feedstream.

Embodiment 20

The process of any previous embodiment, wherein the first hydrogen-containing treat gas stream and the second hydrogen-containing treat gas stream contain at least 85 mol % hydrogen.

Embodiment 21

The process of any previous embodiment, wherein the naphtha feedstream has a gum content of at least 25 mg/100 ml and the pretreater product stream has a gum content of less than 5 mg/100 ml.

Embodiment 22

The process of any previous embodiment, wherein the pretreater product stream retains at least 95 wt % of the naphtha weight boiling point materials (hydrocarbons boiling in the range of 80 to 450° F.) present in the naphtha feedstream.

The principles and modes of operation of this invention have been described above with reference to various exemplary and preferred embodiments. As understood by those of skill in the art, the overall invention, as defined by the claims, encompasses other preferred embodiments not specifically enumerated herein.

EXAMPLE

A pilot plant was developed for testing the concept of the pretreater reactor circuit described herein.

An upflow reactor design was used to ensure complete catalyst wetting and ensure plug flow throughout the reactor. The reactor has an internal diameter of approximately 0.824 inches and an overall available bed height of about 40". The bottom (inlet) of the reactor bed contained approximately 2.5" height of 8/14 (particle size range from 0.046 to 0.093 inches) tabular alumina (inert). On top of this placed approximately 25.5" height of a mixture of 50 cc of 8/14 tabular alumina (inert) and 50 cc of a KF-841® catalyst which is an alumina supported NiW manufactured by Albemarle®. On top of this was placed approximately 0.625" height of 8/14 tabular alumina (inert). The tabular alumina is an inert material and was used as catalyst support for the catalyst bed as well as within the catalyst bed to ensure complete and uniform contact of the feed with the active catalyst in the plant scale reactor. The catalyst was sulfide prior to running the process testing. A total of four (4) thermocouples were placed at varying elevations with the active reactor bed.

The testing covered the following range of conditions:

Temperature=325 to 375° F. (163 to 191° C.)

Treat gas rate=600 SCF/B (101 $Nm^3/m^3$)

Pressure=530 psig (36 barg)

LHSV=2 to 6 $hr^{-1}$

The pilot plant feed was a heavy cat naphtha, which contained a high level of gums (40 mg/100 ml). Naphtha feeds with more than 5 mg/100 ml ASTM gums are considered to have a significant propensity for causing fouling in hydrodesulfurization reactor catalyst beds and associated equipment.

The conditions and results from the testing are shown in FIG. 4. The test was run for 16 days with product samples taken and analyzed at Days 4, 5, 9, 13, and 16 with the product compositional results of the naphtha feed as well as the liquid reaction products obtained shown in the table in FIG. 4. Significant feed gum removal was observed throughout the pilot plant run. The naphtha feed to the process in this Example contained 39.5 mg/100 ml gums, while the total liquid naphtha product retrieved from the process had less than 2.5 mg/100 ml gums under all tested process conditions. This demonstrates that mild conditions were sufficient for significant gum removal (about 325 to 350° F., 530 psig, and 4 $hr^{-1}$ LHSV) with the processes described herein.

Importantly, it should also be noted from the data in FIG. 4 that the olefin content (as shown by the Bromine #) remained very high. At the lower severity (reactor temperature of 325° F.), over 85% of the feed olefins were retained in the product. In all cases measured, over 70% of the olefins were retained in the product.

It is noted that there was experienced a rapid reactor pressure drop buildup starting on Day 14 and on Day 16 the test run terminated. However, subsequent analyses confirmed that the high reactor bed delta pressures were due primarily to corrosion products in the inlet filter and inlet of the catalyst bed and are believed to be associated primarily with corrosion products from the equipment (high iron content in the residue) and not a result of the process itself or from any significant amount of the gums being deposited in the filter and reactor system. The reactor catalyst was discharged and the catalyst was found to be free flowing with only a small amount of black residue found at the reactor inlet, underneath the catalyst bed support.

What is claimed is:

1. A process for selectively pretreating and desulfurizing a catalytically cracked naphtha feedstream, comprising:

contacting, in a pretreater reactor, the naphtha feedstream and a first hydrogen-containing treat gas with a pretreater catalyst comprising an alumina-containing support and at least one Column 6 metal and at least one Column 8, 9 or 10 metal, wherein the gum content of the naphtha feedstream is at least 5 mg/100 ml, and the conditions within the pretreater reactor are about 100 to 1000 psig and about 300 to 400° F., and the first hydrogen-containing treat gas rate is about 300 to 1000 SCF/B;

retrieving a pretreater product stream from the pretreater reactor wherein the pretreater product stream has a gum content of less than 20% of the gum content of the naphtha feedstream;

heating the pretreater product stream;

contacting, in a first naphtha hydrodesulfurization reactor, the heated pretreater product stream and a second hydrogen-containing treat gas with a first naphtha hydrodesulfurization catalyst comprising at least one Column 6 metal and at least one Column 8, 9 or 10 metal, wherein the conditions within the first naphtha hydrodesulfurization reactor are about 100 to 1000 psig and about 400 to 750° F., and the second hydrogen-containing treat gas rate is about 1000 to 4000 SCF/B; and retrieving a first naphtha hydrodesulfurization product stream from the first naphtha hydrodesulfurization reactor;

wherein the: first naphtha hydrodesulfurization product stream has a lower sulfur content than the naphtha feedstream.

2. The process of claim 1, wherein the pretreater product stream has a gum content of less than 10% of the gum content of the naphtha feedstream.

3. The process of claim 1, wherein the naphtha feedstream is a full-cut naphtha boiling substantially in the range of about 80 to 450° F.

4. The process of claim 1, wherein the naphtha feedstream is a heavy cat naphtha boiling substantially in the range of about 250 to 450° F.

5. The process of claim 4, wherein a light cat naphtha stream, boiling substantially in the range of about 80 to 250° F., is added to the pretreater product stream prior to entering the first naphtha hydrodesulfurization reactor.

6. The process of claim 1, wherein more than 70% of the olefins present in the naphtha feedstream are retained in the pretreater product stream.

7. The process of claim 1, wherein the at least one Column 6 metal of the pretreater catalyst is W and the at least one Column 8, 9 or 10 metal of the pretreater catalyst is Ni.

8. The process of claim 1, wherein the sulfur content, by wt %, of the naphtha-weight boiling point components (hydrocarbons boiling in the range of 80 to 450° F.) of the pretreater product stream is at least 80% of the sulfur content, by wt %, of the naphtha-weight boiling point components (hydrocarbons boiling in the range of 80 to 450° F.) of the naphtha feedstream.

9. The process of claim 1, wherein the first hydrogen-containing treat gas stream and the second hydrogen-containing treat gas stream contain at least 85 mol % hydrogen.

10. The process of claim 1, wherein the sulfur content of the naphtha feedstream is at least 500 ppmw and the sulfur content of the first naphtha hydrodesulfurization product stream is less than 100 ppmw.

11. The process of claim 1, wherein the naphtha feedstream has a gum content of at least 25 mg/100 ml and the pretreater product stream has a gum content of less than 5 mg/1100 ml.

12. The process of claim 1, wherein the pretreater product stream retains at least 95 wt % of the naphtha weight boiling point materials (hydrocarbons boiling in the range of 80 to 450° F.) present in the naphtha feedstream.

13. The process of claim 1, further comprising:

cooling the first naphtha hydrodesulfurization product stream;

sending the cooled first naphtha hydrodesulfurization product stream to a product separator and removing at least a portion of hydrogen and $H_2S$ as a product separator overhead gas and removing a separator liquid product stream comprising hydrocarbon components boiling in the range of 80 to 450° F.;

heating the separator liquid product stream;

sending the heated separator liquid product stream to a product stripper wherein the heated separator liquid product stream contacts a series of internal fractionating devices selected from distillation trays, packing and grids;

removing a stripper overhead gas from the product stripper;

separating the stripper overhead gas into an overhead receiver offgas comprising $H_2S$ and ethane and an LPG liquid stream comprising $C_3$, $C_4$, and $C_5$ hydrocarbons;

removing a desulfurized naphtha product stream from the product stripper;

sending at least a portion of the desulfurized naphtha product stream to gasoline blending; and heating at least a portion of the desulfurized naphtha product stream and returning it to the product stripper.

14. The process of claim 1, further comprising:

removing at least a portion of hydrogen and $H_2S$ from the first naphtha hydrodesulfurization product stream there by producing an interstage liquid stream;

contacting, in a second naphtha hydrodesulfurization reactor, the interstage liquid stream and a third hydrogen-containing treat gas with a second naphtha hydrodesulfurization catalyst comprising at least one Column 6 metal and at least one Column 8, 9 or 10 metal, wherein the conditions within the second naphtha hydrodesulfurization reactor are about 100 to 1000 psig and about 400 to 750° F., and the second hydrogen-containing treat gas rate is about 1000 to 4000 SCF/B; and retrieving a second naphtha hydrodesulfurization product stream from the second naphtha hydrodesulfurization reactor;

wherein the second naphtha hydrodesulfurization product stream has a lower sulfur content than the first naphtha hydrodesulfurization product stream.

15. The process of claim 14, wherein the pretreater product stream has a gum content of less than 10% of the gum content of the naphtha feedstream.

16. The process of claim 14, wherein the naphtha feedstream is a full-cut naphtha boiling substantially in the range of about 80 to 450° F.

17. The process of claim 14, wherein the naphtha feedstream is a heavy cat naphtha boiling substantially in the range of about 250 to 450° F.

18. The process of claim 17, wherein a light cat naphtha stream, boiling substantially in the range of about 80 to 250° F., is added to the pretreater product stream prior to entering the first naphtha hydrodesulfurization reactor.

19. The process of claim 14, wherein more than 70% of the olefins present in the naphtha feedstream are retained in the pretreater product stream.

20. The process of claim 14, wherein the at least one Column 6 metal of the pretreater catalyst is W and the at least one Column 8, 9 or 10 metal of the pretreater catalyst is Ni.

21. The process of claim 14, wherein the sulfur content, by wt %, of the naphtha-weight boiling point components (hydrocarbons boiling in the range of 80 to 450° F.) of the pretreater product stream is at least 80% of the sulfur content, by wt %, of the naphtha-weight boiling point components (hydrocarbons boiling in the range of 80 to 450° F.:) of the naphtha feedstream.

22. The process of claim 14, wherein the sulfur content of the naphtha feedstream is at least 500 ppmw, the sulfur content of the first naphtha hydrodesulfurization product stream is at least 100 ppmw, and the sulfur content of the second naphtha hydrodesulfurization product stream is less than 30 ppmw.

23. The process of claim 14, wherein the naphtha feedstream has a gum content of at least 25 mg/100 ml and the pretreater product stream has a gum content of less than 5 mg/100 ml.

24. The process of claim 14, wherein the pretreater product stream retains at least 95 wt % of the naphtha weight boiling point materials (hydrocarbons boiling in the range of 80 to 450° F.) present in the naphtha feedstream.

25. The process of claim 14, further comprising:

cooling the second naphtha hydrodesulfurization product stream;

sending the cooled first naphtha hydrodesulfurization product stream to a product separator and removing at least a portion of the hydrogen and $H_2S$ as a product separator overhead gas and removing a separator liquid product stream comprising hydrocarbon components boiling in the range of 80 to 450° F.;

heating the separator liquid product stream;

sending the heated separator liquid product stream to a product stripper wherein the heated separator liquid product stream contacts a series of internal fractionating devices selected from distillation trays, packing and grids;

removing a stripper overhead gas from the product stripper;

separating the stripper overhead gas into an overhead receiver offgas comprising $H_2S$ and ethane and an LPG liquid stream comprising $C_3$, $C_4$, and $C_5$ hydrocarbons;

removing a desulfurized naphtha product stream from the product stripper;

sending at least a portion of the desulfurized naphtha product stream to gasoline blending; and heating at least a portion of the desulfurized naphtha product stream and returning it to the product stripper.

26. A process for selectively pretreating and desulfurizing a catalytically cracked naphtha feedstream, comprising:

contacting, in a pretreater reactor, the naphtha feedstream and a first hydrogen-containing treat gas with a pretreater catalyst comprising an alumina-containing support and at least one Column 6 metal and at least one Column 8, 9 or 10 metal, wherein the gum content of the naphtha feedstream is at least 5 mg/100 iml, and the conditions within the pretreater reactor are about 100 to 1000 psig and about 300 to 400° F., and the first hydrogen-containing treat gas rate is about 300 to 1000 SCF/B;

retrieving a pretreater product stream from the pretreater reactor wherein the pretreater product stream has a gum content of less than 20% of the gum content of the naphtha feedstream;

heating the pretreater product stream;

contacting, in a first naphtha hydrodesulfurization reactor, the heated pretreater product stream and a second hydrogen-containing treat gas with a first naphtha hydrodesulfurization catalyst comprising at least one Column 6 metal and at least one Column 8, 9 or 10 metal, wherein the conditions within the first naphtha hydrodesulfurization reactor are about 100 to 1000 psig and about 400 to 750° F., and the second hydrogen-containing treat gas rate is about 1000 to 4000 SCF/B;

retrieving a first naphtha hydrodesulfurization product stream from the first naphtha hydrodesulfurization reactor wherein the first naphtha hydrodesulfurization product stream has a lower sulfur content than the naphtha feedstream;

removing at least a portion of the hydrogen and $H_2S$ from the first naphtha hydrodesulfurization product stream thereby producing an interstage liquid stream;

contacting, in a naphtha conversion reactor, the interstage liquid stream and a third hydrogen-containing treat gas with a naphtha conversion catalyst comprising an alumina-containing support and an acidic zeolite with a pore size from about 5 to 7Å, wherein the conditions within the naphtha conversion reactor are about 300 to 1500 psig and about 300 to 800° F., and the third hydrogen-containing treat gas rate is about 500 to 4000 SCF/B; and retrieving a naphtha conversion product stream from the naphtha conversion reactor;

wherein the naphtha conversion product stream has a higher olefin content than the first naphtha hydrodesulfurization product stream.

27. The process of claim 26, wherein the olefin content of the naphtha conversion product stream is at least 5% greater than the olefin content of the first naphtha hydrodesulfurization product stream.

28. The process of claim 26, wherein the naphtha conversion catalyst is comprised of at least one Column 6 metal selected from Mo and W and at least one Column 8, 9 or 10 metal selected from Co, Ni, Pt and Pd.

29. The process of claim 26, wherein the naphtha conversion catalyst is comprised of at least one Column 10 metal selected from Pt and Pd.

30. The process of claim 26, wherein the pretreater product stream has a gum content of less than 10% of the gum content of the naphtha feedstream.

31. The process of claim 26, wherein the naphtha feedstream is a full-cut naphtha boiling substantially in the range of about 80 to 450° F.

32. The process of claim 26, wherein the naphtha feedstream is a heavy cat naphtha boiling substantially in the range of about 250 to 450° F.

33. The process of claim 32, wherein a light cat naphtha stream, boiling substantially in the range of about 80 to 250° F., is added to the pretreater product stream prior to entering the first naphtha hydrodesulfurization reactor.

34. The process of claim 26, wherein more than 70% of the olefins present in the naphtha feedstream are retained in the pretreater product stream.

35. The process of claim 26, wherein the at least one Column 6 metal of the pretreater catalyst is W and the at least one Column 8, 9 or 10 metal of the pretreater catalyst is Ni.

36. The process of claim 26, wherein the sulfur content, by wt %, of the naphtha-weight boiling point components (hydrocarbons boiling in the range of 80 to 450° F.) of the pretreater product stream is at least 80% of the sulfur content, by wt %, of the naphtha-weight boiling point components (hydrocarbons boiling in the range of 80 to 450° F.) of the naphtha feedstream.

37. The process of claim 26, wherein the sulfur content of the naphtha feedstream is at least 500 ppmw, and the sulfur content of the first naphtha hydrodesulfurization product stream is less than 50 ppmw.

38. The process of claim 26, wherein the naphtha feedstream has a gum content of at least 25 mg/100 ml and the pretreater product stream has a gum content of less than 5 mg/100 ml.

39. The process of claim 26, wherein the pretreater product stream retains at least 95 wt % of the naphtha weight boiling point materials (hydrocarbons boiling in the range of 80 to 450° F.) present in the naphtha feedstream.

40. The process of claim 26, wherein the naphtha conversion catalyst has a surface area of at least 50 $m^2/g$ and comprises ZSM-5.

41. The process of claim 26, further comprising:

cooling the naphtha conversion product stream;

sending the cooled naphtha conversion product stream to a product separator and removing at least a portion of the hydrogen and $H_2S$ as a product separator overhead gas and removing a separator liquid product stream comprising hydrocarbon components boiling in the range of 80 to 450° F.;

heating the separator liquid product stream;

sending the heated separator liquid product stream to a product stripper wherein the heated separator liquid product stream contacts a series of internal fractionating devices selected from distillation trays, packing and grids;

removing a stripper overhead gas from the product stripper;

separating the stripper overhead gas into an overhead receiver offgas comprising $H_2S$ and ethane and an LPG liquid stream comprising $C_3$, $C_4$, and $C_5$ hydrocarbons;

removing a desulfurized naphtha product stream from the product stripper;

sending at least a portion of the desulfurized naphtha product stream to gasoline blending; and heating at least a portion of the desulfurized naphtha product stream and returning it to the product stripper.

* * * * *